US009649691B2

(12) United States Patent
Sasaki

(10) Patent No.: US 9,649,691 B2
(45) Date of Patent: May 16, 2017

(54) METHOD OF PRODUCING RARE EARTH ALLOY FLAKES

(71) Applicant: CHUO DENKI KOGYO CO., LTD., Tokyo (JP)

(72) Inventor: Hideo Sasaki, Wakayama (JP)

(73) Assignee: SANTOKU CORPORATION, Hyogo (JP)

( * ) Notice: Subject to any disclaimer, the term of this patent is extended or adjusted under 35 U.S.C. 154(b) by 221 days.

(21) Appl. No.: 14/373,389

(22) PCT Filed: Jan. 23, 2013

(86) PCT No.: PCT/JP2013/000298
§ 371 (c)(1),
(2) Date: Jul. 21, 2014

(87) PCT Pub. No.: WO2013/111573
PCT Pub. Date: Aug. 1, 2013

(65) Prior Publication Data

US 2014/0360315 A1 Dec. 11, 2014

(30) Foreign Application Priority Data

Jan. 24, 2012 (JP) ..... 2012-012288

(51) Int. Cl.

| | |
|---|---|
| ***B22F 9/08*** | (2006.01) |
| ***B22D 11/00*** | (2006.01) |
| ***B22D 11/11*** | (2006.01) |
| ***B22D 11/06*** | (2006.01) |
| ***B22F 1/00*** | (2006.01) |

(52) U.S. Cl.
CPC ..... *B22F 9/08* (2013.01); *B22D 11/00* (2013.01); *B22D 11/0611* (2013.01); *B22D 11/11* (2013.01); *B22F 1/0055* (2013.01); *B22F 2301/45* (2013.01)

(58) Field of Classification Search
None
See application file for complete search history.

(56) References Cited

U.S. PATENT DOCUMENTS 5,665,177 A * 9/1997 Fukuno ..... B22D 11/0611 148/101
6,401,799 B1 * 6/2002 Arai ..... H01F 1/0578 164/423
7,442,262 B2 * 10/2008 Sasaki ..... B22F 1/0007 148/101

FOREIGN PATENT DOCUMENTS

| | | |
|---|---|---|
| JP | 03-234337 | 10/1991 |
| JP | 09-1296 | 1/1997 |
| JP | 10-36949 | 2/1998 |
| JP | 2002-059245 | 2/2002 |
| JP | 2003-188006 | 7/2003 |
| JP | 2003-211257 | 7/2003 |
| WO | 2012/002531 | 1/2012 |

OTHER PUBLICATIONS

English translation of JP 2002-059245 A (published Feb. 26, 2002) from J-Plat Pat.*

* cited by examiner

*Primary Examiner* — George Wyszomierski
(74) *Attorney, Agent, or Firm* — Clark & Brody

(57) ABSTRACT

When a ribbon is cast by heating raw materials to prepare a molten R-T-B-based alloy and supplying the molten alloy to a chill roll to solidify the molten alloy, the temperature of the molten alloy is adjusted in accordance with at least one of the arithmetic mean roughness Ra and the mean spacing of profile irregularities Sm of the surface of the chill roll, thereby controlling the spacing between adjacent R-rich phases in a crystal structure of resulting alloy flakes to a desired value. This makes it possible to inhibit variations in the crystal structure of the resulting alloy flakes that may occur due to wear of the chill roll. In adjusting the temperature of the molten alloy in accordance with at least one of the arithmetic mean roughness Ra and the mean spacing of profile irregularities Sm, it is preferred that the molten alloy temperature be adjusted using the equation: $\Delta t=-7\times(|\Delta Ra|\times|\Delta Sm|)^{0.5}/\alpha$ where $\Delta t$ is an amount of adjustment of the molten alloy temperature (° C.); $\Delta Ra$ is an amount of change (μm) in the arithmetic mean roughness Ra; $\Delta Sm$ is an amount of change (μm) in the mean spacing of profile irregularities Sm; and $\alpha$ is a correlation coefficient.

8 Claims, No Drawings

METHOD OF PRODUCING RARE EARTH ALLOY FLAKES

TECHNICAL FIELD

The present invention relates to a method of producing rare earth alloy flakes, the method including casting a ribbon by supplying a molten R-T-B-based alloy to a chill roll and solidifying the molten alloy on the chill roll. More particularly, the present invention relates to a method of producing rare earth alloy flakes capable of inhibiting variations in the crystal structure of the resulting alloy flakes that may be caused by a change in the surface texture of a chill roll due to wear.

BACKGROUND ART

In recent years, R-T-B-based alloys, which exhibit good magnetic properties, have been available as a rare earth magnet alloy. In the term "R-T-B-based alloys" as used herein, "R" refers to rare earth metals, "T" refers to transition metals with Fe being an essential element, and "B" refers to boron. Alloy flakes of R-T-B-based alloys can be produced by a rapid solidification process. In a rapid solidification process, a molten R-T-B-based alloy is prepared by heating raw materials, and the molten alloy is supplied to a chill roll and solidified thereon so that it can be cast into a ribbon. For the rapid solidification process, strip casting methods are widely used.

When a strip casting method is employed for the rapid solidification process, rare earth alloy flakes may be produced by the following procedure, for example:

(a) A molten R-T-B-based alloy is prepared by loading raw materials into a crucible and heating and melting them;

(b) The molten alloy is supplied, via a tundish, to the outer peripheral surface of a chill roll having a structure in which coolant circulates. With this, the molten alloy is quenched and solidified to be cast into a ribbon having a thickness of 0.1 to 1.0 mm;

(c) The cast ribbon is crushed into alloy flakes, and the alloy flakes are cooled.

In this procedure, the above operations (a) to (c) are usually carried out under reduced pressure or in an inert gas atmosphere to prevent oxidation of the R-T-B-based alloy.

Such casting of ribbons by a rapid solidification process using a chill roll is typically carried out in a batch manner because of the limited capacity of a crucible for melting the loaded raw materials into the molten alloy. Furthermore, the chill roll is repeatedly used over several casting operations.

Rare earth alloy flakes produced by a rapid solidification process have an alloy crystal structure in which a crystalline phase (principal phase) and an R-rich phase coexist. The crystalline phase is an $R_2T_{14}B$ phase, and the R-rich phase is enriched with the rare earth metal. The principal phase is a ferromagnetic phase that contributes to magnetization, and the R-rich phase is a non-magnetic phase that does not contribute to magnetization.

The alloy crystal structure containing a principal phase and an R-rich phase can be evaluated based on the spacing between adjacent R-rich phases (inter-R-rich phase spacing). In measurement of the inter-R-rich phase spacing, the cross section taken along the thickness direction (cross section in the thickness direction) of the produced alloy flake is examined, and the inter-R-rich phase spacing, which is a distance between an R-rich phase and an adjacent R-rich phase, is measured. Hereinafter, among R-rich phases, an R-rich phase enriched with Nd as a rare earth metal is also particularly referred to as an "Nd-rich phase".

Rare earth alloy flakes produced by a rapid solidification process may be used as a material for rare earth sintered magnets and bonded magnets. If variations occur in the crystal structure of the rare earth alloy flakes that serve as the material and the distribution of the ferromagnetic principal phase and the non-magnetic R-rich phase is non-uniform, the resulting rare earth magnet will have decreased characteristics or suffer variations in product quality. Because of this, in the production of rare earth alloy flakes, there is a need for inhibiting the variations in the crystal structure of the resulting alloy flakes.

However, a chill roll that is used in casting of ribbons experiences a change in surface texture due to wear that is caused by repeated use in several casting operations. If the surface texture of a chill roll changes, the inter-R-rich phase spacing of resulting alloy flakes will vary. Thus, even if the alloy flakes are produced under the same casting conditions, the crystal structure of the alloy flakes will vary among individual casting operations, and this poses a problem.

With regard to ribbon casting by a rapid solidification process using a chill roll, there are various conventional proposals as disclosed in Patent Literatures 1 to 4, for example. Patent Literature 1 discloses a chill roll having a roll outer peripheral surface formed of a wear resistant metallic layer, the roll outer peripheral surface having a surface roughness Ra 2 of 0.1 to 10 μm in a widthwise central area thereof and a surface roughness Ra 1 of 2 to 20 μm in both side areas, wherein Ra 1 is greater than Ra 2. According to Patent Literature 1, this configuration inhibits variations in the crystal structure of the alloy between portions solidified on the central area of the chill roll and portions solidified on the side areas, thereby allowing production of alloy flakes having a fine and uniform crystal structure.

Patent Literature 2 discloses a chill roll having a roll outer peripheral surface configured such that the value of Sm/Ra defined by the mean spacing of profile irregularities Sm (mm) and the arithmetic mean roughness Ra (μm) is in the range of 0.03 to 0.12 (mm/μm), and that the mean spacing of profile irregularities Sm is in the range of 0.1 to 0.6 mm According to Patent Literature 2, this configuration homogenizes the crystal structure of the resulting rare earth alloy.

Patent Literature 3 relates to a method for repairing a chill roll that has been worn due to repeated use in several casting operations. The method of repairing a chill roll disclosed in Patent Literature 3 includes repairing a chill roll having a body provided with a thermally conductive layer on the outer periphery thereof and a metallic layer formed on the outer periphery of the thermally conductive layer, the method being performed by the following procedure:

(1) Removing a given amount of thickness from the outer peripheral surface of the chill roll;

(2) Conditioning the outer peripheral surface of the chill roll after removal of the given amount of thickness such that the center line average roughness is in the range of 1 to 50 μm; and (3) Forming a metallic layer having a thickness determined by the thermal conductivity of the metallic layer to be formed, the thermal conductivity of the metallic layer on the outer peripheral surface from which a given amount of thickness was removed, and the center line average roughness of the outer peripheral surface from which a given amount of thickness was removed.

According to Patent Literature 3, by repairing the chill roll in accordance with the above steps (1) to (3), it is possible to return the chill roll to the state in which it provides cooling performance substantially comparable to that of a newly manufactured chill roll, and therefore to retain the quality of resulting alloy flakes stably and for a long period of time.

Patent Literature 4 discloses a chill roll having an outer peripheral surface configured to have a surface roughness represented by a ten point height of irregularities (Rz) of 5 to 100 μm. According to Patent Literature 4, by using a chill roll having irregularities on its outer peripheral surface, it is possible to prevent the ribbon surface that is brought into contact with the chill roll from being excessively quenched and to inhibit the production of fine R-rich phases near the ribbon surface that is brought into contact with the chill roll. It is stated that this configuration provides a homogeneous dispersion of R-rich phases in the side of the ribbon surface that is brought into contact with the chill roll and in the opposite side of the ribbon surface.

CITATION LIST

Patent Literature

Patent Literature 1: Japanese Patent Application Publication No. H09-1296

Patent Literature 2: Japanese Patent Application Publication No. 2002-059245

Patent Literature 3: Japanese Patent Application Publication No. 2003-211257

Patent Literature 4: Japanese Patent Application Publication No. 2003-188006

SUMMARY OF INVENTION

Technical Problem

As stated above, in the production of rare earth alloy flakes, it is desired to inhibit the variations that may occur in the crystal structure of the resulting alloy flakes in order to stably ensure characteristics and quality of rare earth magnets to be made from the alloy flakes. However, since wear occurs in the chill roll due to repeated use over several casting operations, the crystal structure of the resulting alloy flakes will vary among individual casting operations even if the alloy flakes are produced under the same casting conditions.

Patent Literatures 1 to 4 listed above each disclose ribbon casting by a rapid solidification process using a chill roll. Patent Literatures 1 to 4 are all intended to inhibit variations in the crystal structure of a cast ribbon that may occur in the roll width direction or thickness direction, or the like, and this object is to be accomplished by specifying a certain surface texture for the chill roll.

As such, none of these literatures, Patent Literatures 1 to 4, address the problem of the variations in the crystal structure of the resulting alloy flakes among individual casting operations due to wear of a chill roll, which causes a change in the surface texture thereof. Therefore, any of the chill rolls disclosed in Patent Literatures 1 to 4 suffer a change in the surface texture when repeatedly used for several casting operations, which result in variations in the crystal structure of the alloy flakes among individual casting operations.

The present invention has been made in view of this situation. Accordingly, an object of the present invention is to provide a method of producing rare earth alloy flakes which is capable of controlling the inter-R-rich phase spacing of the resulting alloy flakes to a desired value and of inhibiting variations in the crystal structure of the alloy flakes that may occur among individual casting operations even when a worn chill roll is used.

Solution to Problem

In order to solve the above-described problem, the present inventor carried out a variety of experiments and conducted intensive study and research. As a result, he has found that, in ribbon casting by solidifying a supplied molten R-T-B-based alloy on a chill roll, the temperature of the molten alloy should be adjusted in accordance with at least one of the arithmetic mean roughness Ra (as defined in JIS B 0601) and the mean spacing of profile irregularities Sm (as defined in JIS B 0601) of the surface of the chill roll. This allows control of the inter-R-rich phase spacing of the resulting alloy flakes to a desired value even when a worn chill roll is used, thus making it possible to inhibit variations in the crystal structure of the alloy flakes that may occur among individual casting operations.

Furthermore, the present inventor studied the relationship between the molten alloy temperature at which the inter-R-rich phase spacing reaches a desired value and the arithmetic mean roughness Ra and the mean spacing of profile irregularities Sm of the surface of the chill roll. As a result, he has found that the amount of adjustment of the molten alloy temperature Δt (° C.) to achieve a desired value of the inter-R-rich phase spacing is correlated to the amount of change ΔRa (μm) in the arithmetic mean roughness Ra of the surface of the chill roll and the amount of change ΔSm (μm) in the mean spacing of profile irregularities Sm of the surface of the chill roll.

The present invention has been accomplished based on the above findings, and the summaries thereof are set forth below in items (1) to (3) relating to the method of producing rare earth alloy flakes.

(1) A method of producing rare earth alloy flakes, including, casting a ribbon by heating raw materials to prepare a molten R-T-B-based alloy and supplying the molten alloy to a chill roll to solidify the molten alloy, the method comprising: adjusting a temperature of the molten alloy in accordance with at least one of an arithmetic mean roughness Ra (as defined in JIS B 0601) and a mean spacing of profile irregularities Sm (as defined in JIS B 0601) of a surface of the chill roll to control a spacing between adjacent R-rich phases in a crystal structure of resulting alloy flakes to a desired value.

(2) The method of producing rare earth alloy flakes according to the above item (1), wherein, in adjusting the temperature of the molten alloy in accordance with at least one of an arithmetic mean roughness Ra (as defined in JIS B 0601) and a mean spacing of profile irregularities Sm (as defined in JIS B 0601) of the surface of the chill roll, the adjustment is made in accordance with the following equation (1):

$$\Delta t=-7\times(|\Delta Ra|\times|\Delta Sm|)^{0.5}/\alpha \quad (1)$$ where Δt: an amount of adjustment (° C.) to be made to the molten alloy temperature;

ΔRa: an amount of change (μm) in the arithmetic mean roughness Ra (as defined in JIS B 0601) of the surface of the chill roll;

ΔSm: an amount of change (μm) in the mean spacing of profile irregularities Sm (as defined in JIS B 0601) of the surface of the chill roll; and α: a correlation coefficient (α>0).

(3) The method of producing rare earth alloy flakes according to the above item (1) or (2), wherein the surface of the chill roll has an arithmetic mean roughness Ra (as defined in JIS B 0601) of 2 to 20 μm and a mean spacing of profile irregularities Sm (as defined in JIS B 0601) of 100 to 1000 μm.

Advantageous Effects of Invention

The method of producing rare earth alloy flakes of the present invention includes: adjusting the temperature of a molten alloy in accordance with at least one of the arithmetic mean roughness Ra and the mean spacing of profile irregularities Sm of the surface of the chill roll. This allows control of the inter-R-rich phase spacing of the resulting alloy flakes to a desired value even when a worn chill roll is used, thus making it possible to inhibit variations in the crystal structure of the alloy flakes that may occur among individual casting operations.

DESCRIPTION OF EMBODIMENTS

The method of producing rare earth alloy flakes of the present invention includes casting a ribbon by heating raw materials to prepare a molten R-T-B-based alloy and supplying the molten alloy to a chill roll to solidify the molten alloy. In this operation, according to the method of the present invention, the temperature of the molten alloy is adjusted in accordance with at least one of the arithmetic mean roughness Ra and the mean spacing of profile irregularities Sm of the surface of the chill roll to control the spacing between adjacent R-rich phases (inter-R-rich phase spacing) in the crystal structure of resulting alloy flakes to a desired value.

In the first casting operation, in which a molten alloy is supplied to a chill roll which has a certain finished surface texture, the molten alloy does not easily flow into small recesses that have been formed in the surface of the chill roll. Thus, part of the surface of the chill roll is not brought into contact with the molten alloy. When the chill roll is repeatedly used for several casting operations, the small recesses increase in width and depth due to wear, with the result that the arithmetic mean roughness Ra increases and the mean spacing of profile irregularities Sm increases.

When a molten alloy is supplied to the chill roll whose arithmetic mean roughness Ra and mean spacing of profile irregularities Sm have increased, the molten alloy easily flows into the small recesses having an increased width and depth. This results in an increased area of contact between the molten alloy and the chill roll, causing an increase in the cooling rate of the molten alloy that is cooled by the chill roll. Because of this, when a chill roll whose arithmetic mean roughness Ra and mean spacing of profile irregularities Sm have increased is used, the resulting alloy flakes will have a crystal structure with a smaller inter-R-rich phase spacing. Consequently, variations occur in the crystal structure of the resulting alloy flakes among individual casting operations due to the change in the surface texture of the chill roll.

On the other hand, in the method of producing rare earth alloy flakes of the present invention, the temperature of the molten alloy is adjusted in accordance with at least one of the arithmetic mean roughness Ra and the mean spacing of profile irregularities Sm of the surface of the chill roll. With this adjustment, the viscosity of the molten alloy to be supplied to the chill roll is changed so that a variation in the area of contact between the molten alloy and the chill roll is prevented. Thus, it is possible to maintain the cooling rate of the molten alloy. As such, the method of producing rare earth alloy flakes of the present invention is capable of controlling the inter-R-rich phase spacing of the resulting alloy flakes to a desired value even when the surface texture of a chill roll is changed due to repeated use over several casting operations. Thus, it is capable of inhibiting variations in the crystal structure of the alloy flakes that may occur among individual casting operations.

The adjustment of the molten alloy temperature which is made in accordance with at least one of the arithmetic mean roughness Ra and the mean spacing of profile irregularities Sm of the surface of the chill roll may be carried out, for example, by any of the following: lowering the molten alloy temperature with the increase in the arithmetic mean roughness Ra; lowering the molten alloy temperature with the increase in the mean spacing of profile irregularities Sm; or lowering the molten alloy temperature in accordance with the arithmetic mean roughness Ra and the mean spacing of profile irregularities Sm.

When a chill roll is repeatedly used over several casting operations, small recesses have an increased width and depth due to wear, with the result that the arithmetic mean roughness Ra increases and the mean spacing of profile irregularities Sm increases as described above. When the molten alloy temperature is lowered in accordance with either the increase in the arithmetic mean roughness Ra or the increase in the mean spacing of profile irregularities Sm, or both of them, the viscosity of the molten alloy increases. This prevents the molten alloy from easily flowing into the small recesses having an increased width and depth, making it possible to prevent a variation in the area of contact between the molten alloy and the chill roll and to maintain the cooling rate of the molten alloy cooled by the chill roll. As a result, it is possible to control the inter-R-rich phase spacing of the resulting alloy flakes to a desired value.

The method of producing rare earth alloy flakes of the present invention is preferably performed such that, in adjusting the temperature of the molten alloy in accordance with at least one of the arithmetic mean roughness Ra and the mean spacing of profile irregularities Sm of the surface of the chill roll, the adjustment is made in accordance with the following equation (1). With this, it is possible to stably control the inter-R-rich phase spacing of the resulting alloy flakes to a desired value as detailed in the later-described examples.

$$\Delta t = -7 \times (|\Delta Ra| \times |\Delta Sm|)^{0.5}/\alpha \quad (1)$$

where

Δt is an amount of adjustment (° C.) to be made to the molten alloy temperature; ΔRa is an amount of change (μm) in the arithmetic mean roughness Ra (as defined in JIS B 0601) of the surface of the chill roll; ΔSm is an amount of change (μm) in the mean spacing of profile irregularities Sm (as defined in JIS B 0601) of the surface of the chill roll; and α is a correlation coefficient ($\alpha > 0$).

The correlation coefficient α in the equation (1) is variable depending on the casting conditions such as the chemical composition of the molten R-T-B-based alloy, the thickness of the ribbon to be cast, and the amount of molten alloy to be poured per unit time. For example, the correlation coefficient α may be specified by the following procedure:

(A) The arithmetic mean roughness Ra and the mean spacing of profile irregularities Sm of the surface of the chill roll are measured prior to casting, and then the first casting operation is performed.

(B) In the second and subsequent several casting operations (e.g. second to fifth), the arithmetic mean roughness Ra and the mean spacing of profile irregularities Sm of the surface of the chill roll are measured prior to each casting operation and a molten alloy temperature is specified by calculating the amount of molten alloy temperature adjustment Δt by the equation (1), and then casting of a ribbon is performed. In these operations, a plurality of α values are used by specifying a different α value for each casting operation.

(C) In the plurality of casting operations, for each of which a different α value is used, the inter-R-rich phase spacings of the produced alloy flakes are each measured. From the measured results, a determination is made which casting operation has resulted in an inter-R-rich phase spacing closest to the desired inter-R-rich phase spacing. The α value used in the casting operation is adopted as an α value for the casting operations that follow for the calculation of the amount of molten alloy temperature adjustment Δt using the equation (1).

The method of producing rare earth alloy flakes of the present invention preferably uses a chill roll having a surface that has an arithmetic mean roughness Ra of 2 to 20 μm and a mean spacing of profile irregularities Sm of 100 to 1000 μm. With this, it is possible to quench and solidify the molten alloy supplied to the chill roll at a suitable cooling rate and therefore to stably cast a ribbon.

EXAMPLES

To verify the advantages of the method of producing rare earth alloy flakes of the present invention, a test was conducted in which a chill roll was repeatedly used in several casting operations to produce alloy flakes.

[Testing Method]

In this test, in which a chill roll was repeatedly used for several casting operations to produce alloy flakes, the arithmetic mean roughness Ra and the mean spacing of profile irregularities Sm of the surface of the chill roll were measured prior to each casting operation. In each casting operation, a ribbon was cast from 300 kg mass of molten R-T-B-based alloy through the ribbon casting procedure using a strip casting method as described above, and the ribbon was crushed into alloy flakes.

In this test, raw materials loaded into an $Al_2O_3$ crucible were melted by radio frequency induction heating and adjusted to a predetermined temperature (molten alloy temperature). This molten alloy was supplied to a chill roll via a tundish and solidified so that it was cast into a ribbon. In this operation, the amount of the molten alloy to be poured and the number of revolutions of the chill roll were adjusted to cast a ribbon having a width of 300 mm and a thickness of 0.5 mm. Then, the ribbon was crushed into alloy flakes of 30 mm square or less and with a thickness of 0.5 mm. The molten R-T-B-based alloy was prepared by heating a mixture of metallic neodymium, electrolytic iron, and ferroboron with a typical composition thereof being as follows: Fe: 77.7 atomic %; Nd: 13.8 atomic %; and B: 1.0 atomic %. The atmosphere was argon, which is an inert gas, under reduced pressure.

The surface texture of the chill roll used in this test prior to the first casting operation was as follows: in Inventive Example 1, the arithmetic mean roughness Ra was 7.1 μm and the mean spacing of profile irregularities Sm was 363 μm; and in Inventive Example 2, the arithmetic mean roughness Ra was 8.2 μm and the mean spacing of profile irregularities Sm was 425 μm.

Measurements of the arithmetic mean roughness Ra (as defined in JIS B 0601: 2001) and the mean spacing of profile irregularities Sm (as defined in JIS B 0601: 1994) of the surface of the chill roll, which were carried out prior to each casting operation, were made from a widthwise central position of the chill roll to the widthwise direction of the chill roll.

In Inventive Examples 1 and 2, the molten alloy temperature was adjusted in accordance with the surface roughness of the chill roll by the equation (1), and the desired value of the inter-Nd-rich phase spacing in the crystal structure of the resulting alloy flakes was set to 3.0 μm. The molten alloy temperatures for the first casting operations were set as follows: in Inventive Example 1, it was set to a temperature determined by adding 306 (° C.) to a calculated melting temperature (° C.) of the alloy; and in Inventive Example 2, it was set to a temperature determined by adding 293 (° C.) to a calculated melting temperature (° C.) of the alloy.

In the second and subsequent casting operations in Inventive Examples 1 and 2, the difference between the arithmetic mean roughness Ra (μm) of the chill roll measured prior to the casting operation in process and the arithmetic mean roughness Ra (μm) of the chill roll measured prior to the first casting operation was determined That is, the amount of change ΔRa (μm) in the arithmetic mean roughness Ra of the chill roll was determined. Likewise, the difference between the mean spacing of profile irregularities Sm (μm) of the chill roll measured prior to the casting operation in process and the mean spacing of profile irregularities Sm (μm) of the chill roll measured prior to the first casting operation was determined. That is, the amount of change ΔSm (μm) in the mean spacing of profile irregularities Sm of the chill roll was determined. Using the absolute value |ΔRa| (μm) of the amount of change in Ra and the absolute value |ΔSm| (μm) of the amount of change in Sm, the amount of adjustment Δt (° C.) to be made to the molten alloy temperature was calculated by the equation (1). The molten alloy temperatures (° C.) for the second and subsequent casting operations were determined by adding the molten alloy temperature (° C.) in the first casting operation to the calculated amount of adjustment Δt (° C.) to be made to the molten alloy temperature.

In Inventive Examples 1 and 2, the α value was set to 2 in the second casting operation, 3 in the third casting operation, 4 in the fourth casting operation, and 5 in the fifth casting operation. The crystal structures of the alloy flakes produced by the second to fifth casting operations were each examined by measuring the inter-Nd-rich phase spacings. At the completion of the fifth casting operation, a determination was made which casting operation resulted in an inter-Nd-rich phase spacing of the produced alloy flakes closest to the desired value. The α value used in the casting operation was adopted as an α value for the sixth and subsequent casting operations for adjustment of the molten alloy temperature by the equation (1). In Inventive Example 1, forty-five casting operations were performed in total, and in Inventive Example 2, forty-two casting operations were performed in total, so that alloy flakes were produced.

In Comparative Example, the molten alloy temperature was set to a temperature determined by adding 304 (° C.) to a calculated melting temperature (° C.) of the alloy in all casting operations without adjusting the molten alloy temperature. Forty-one casting operations were performed in total, so that alloy flakes were produced.

[Evaluation Index]

In Inventive Examples 1 and 2, the inter-Nd-rich phase spacing of the produced alloy flakes was measured in every tenth casting operation from the first casting operation and in the final casting operation, in addition to the second to fifth casting operations as described above. In Comparative Example, the inter-Nd-rich phase spacing of the produced alloy flakes was measured in every tenth casting operation from the first casting operation.

The measurement of the inter-Nd-rich phase spacing was carried out by the following procedure:

(1) At least two alloy flakes were taken from the produced alloy flakes, and mounted in a resin and polished so that the cross section in the thickness direction can be observed;

(2) Using a scanning electron microscope, backscattered electron images of the cross section of the alloy flakes were photographed;

(3) The photographed backscattered electron images were fed into an image processor, and binarization of the Nd-rich phase and the principal phase was performed based on the luminance; and (4) A line parallel to the surface that was in contact with the chill roll was drawn at a thicknesswise central position of the alloy flake. In each alloy flake, the inter-Nd-rich phase spacing was measured at 10 points on the line, and their mean value was defined as the inter-Nd-rich phase spacing.

In both the inventive examples and comparative example, evaluations of the inter-Nd-rich phase spacings of the produced alloy flakes were made for every tenth casting operation from the first casting operation. Reference symbols in the "evaluation" section of Table 1 have the following meanings.

○: The measured value of the inter-Nd-rich phase spacing is within the range of

±0.1 μm with respect to the desired value.

x: The measured value of the inter-Nd-rich phase spacing is outside the range of ±0.1 μm with respect to the desired value.

[Test Results]

Table 1 shows: the arithmetic mean roughness Ra and the mean spacing of profile irregularities Sm measured before the casting operation was carried out; the absolute value |ΔRa| of the amount of change in the arithmetic mean roughness; the absolute value |ΔSm| of the amount of change in the mean spacing of profile irregularities; the correlation coefficient α used in the calculation by the equation (1); the amount of molten alloy temperature adjustment Δt calculated by the equation (1); the molten alloy temperature; and the inter-Nd-rich phase spacing of the produced alloy flakes and its evaluation, in each casting operation of this test.

TABLE 1

| Classification | Casting No. | Chill Roll Surface Before Casting: Arithmetic Mean Roughness Ra (μm) | Chill Roll Surface Before Casting: Mean Spacing of Profile Irregularities Sm (μm) | \|ΔRa\| (μm) | \|ΔSm\| (μm) | Correlation Coefficient | Δt (° C.) | Molten Alloy Temperature (° C.) | Inter-Nd-rich phase spacing (μm) | Evaluation |
|---|---|---|---|---|---|---|---|---|---|---|
| Inventive Example 1 | 1 | 7.1 | 363 | — | — | — | — | 306 | 3.0 | ○ |
| | 2 | 7.2 | 369 | 0.1 | 6 | 2 | −3 | 303 | 3.3 | — |
| | 3 | 7.4 | 375 | 0.3 | 12 | 3 | −4 | 302 | 3.2 | — |
| | 4 | 7.5 | 376 | 0.4 | 13 | 4 | −4 | 302 | 3.2 | — |
| | 5 | 7.7 | 382 | 0.6 | 19 | 5 | −5 | 301 | 3.0 | ○ |
| | 11 | 8.4 | 401 | 1.3 | 38 | 5 | −10 | 296 | 3.1 | ○ |
| | 21 | 9.6 | 454 | 2.5 | 91 | 5 | −21 | 285 | 3.1 | ○ |
| | 31 | 10.8 | 495 | 3.7 | 132 | 5 | −31 | 275 | 3.0 | ○ |
| | 41 | 11.3 | 532 | 4.2 | 169 | 5 | −37 | 269 | 3.0 | ○ |
| | 45 | 14.2 | 604 | 7.1 | 241 | 5 | −58 | 248 | 3.0 | ○ |
| Inventive Example 2 | 1 | 8.2 | 425 | — | — | — | — | 293 | 3.0 | ○ |
| | 2 | 8.4 | 431 | 0.2 | 6 | 2 | −4 | 289 | 3.3 | — |
| | 3 | 8.8 | 456 | 0.6 | 31 | 3 | −10 | 283 | 3.0 | ○ |
| | 4 | 9.0 | 462 | 0.8 | 37 | 4 | −10 | 283 | 3.2 | — |
| | 5 | 9.2 | 470 | 1.0 | 45 | 5 | −9 | 284 | 3.2 | — |
| | 11 | 10.2 | 511 | 2.0 | 86 | 3 | −31 | 262 | 2.9 | ○ |
| | 21 | 11.4 | 556 | 3.2 | 131 | 3 | −48 | 245 | 2.9 | ○ |
| | 31 | 12.6 | 604 | 4.4 | 179 | 3 | −65 | 228 | 3.0 | ○ |
| | 41 | 13.4 | 636 | 5.2 | 211 | 3 | −77 | 216 | 2.9 | ○ |
| | 42 | 13.6 | 645 | 5.4 | 220 | 3 | −80 | 213 | 3.0 | ○ |
| Comparative Ex. | 1 | 5.2 | 269 | — | — | — | — | 304 | 3.1 | ○ |
| | 11 | 5.5 | 289 | — | — | — | — | 304 | 3.0 | ○ |
| | 21 | 7.8 | 382 | — | — | — | — | 304 | 2.7 | X |
| | 31 | 9.1 | 443 | — | — | — | — | 304 | 2.6 | X |
| | 41 | 10.4 | 502 | — | — | — | — | 304 | 2.3 | X |

The results shown in Table 1 indicate the following: In Comparative Example, the molten alloy temperature was set to a constant value determined by adding 304 (° C.) to a calculated melting temperature (° C.) of the alloy. With the increase in the casting operations performed by one chill roll, the arithmetic mean roughness Ra and the mean spacing of profile irregularities Sm increased while the inter-Nd-rich phase spacing of the resulting alloy flakes decreased. Thus, the inter-Nd-rich phase spacings in early-stage casting operations were evaluated as ○, but in the 21st and subsequent casting operations, the inter-Nd-rich phase spacings were evaluated as x.

In Inventive Example 1, among the alloy flakes produced by the second to fifth casting operations, the alloy flakes produced by the fifth casting operation, in which the α value was 5, achieved an inter-Nd-rich phase spacing equal to the desired value. Accordingly, in the sixth and subsequent casting operations, the molten alloy temperature was adjusted, using the equation (1) with the α value set to 5, in accordance with the arithmetic mean roughness Ra and the mean spacing of profile irregularities Sm of the chill roll. As a result, the inter-Nd-rich phase spacings were all evaluated as ○.

In Inventive Example 2, among the alloy flakes produced by the second to fifth casting operations, the alloy flakes produced by the third casting operation, in which the α value was 3, achieved an inter-Nd-rich phase spacing equal to the desired value. Accordingly, in the sixth and subsequent casting operations, the molten alloy temperature was adjusted, using the equation (1) with the α value set to 3, in accordance with the arithmetic mean roughness Ra and the mean spacing of profile irregularities Sm of the chill roll. As a result, the inter-Nd-rich phase spacings were all evaluated as ○.

These results demonstrate that: by adjusting the temperature of the molten alloy in accordance with the arithmetic mean roughness Ra and the mean spacing of profile irregularities Sm of the surface of the chill roll, it is possible to control the inter-R-rich phase spacing in the crystal structure of the resulting alloy flakes to a desired value, and to inhibit variations in the crystal structure of the alloy flakes that may occur among individual casting operations.

INDUSTRIAL APPLICABILITY

The method of producing rare earth alloy flakes of the present invention includes: adjusting the temperature of a molten alloy in accordance with at least one of the arithmetic mean roughness Ra and the mean spacing of profile irregularities Sm of the surface of the chill roll. With this, it is possible to control the inter-R-rich phase spacing in the crystal structure of the resulting alloy flakes to a desired value, thus making it possible to inhibit variations in the crystal structure of the alloy flakes that may occur among individual casting operations.

Thus, the alloy flakes produced by the method of producing rare earth alloy flakes of the present invention greatly contribute to the improvement in the properties and quality of a rare earth magnet when they are used as a material for the rare earth magnet.

What is claimed is:

1. A method of producing rare earth alloy flakes, the method comprising:

a step of preparing a molten R-T-B-based alloy by heating raw materials; and a step of casting a ribbon by supplying the molten alloy to a chill roll to solidify the molten alloy; wherein:

the R denotes one or more rare earth metals;

the T denotes one or more transition metals with Fe being an essential element;

the step of preparing the molten R-T-B-based alloy and the step of casting the ribbon are performed multiple times under the same casting conditions;

the chill roll is used repeatedly over multiple performances of the step of casting the ribbon;

in the step of preparing the molten R-T-B-based alloy, a temperature of the molten alloy is adjusted in accordance with an arithmetic mean roughness Ra (as defined in JIS B 0601) and a mean spacing of profile irregularities Sm (as defined in JIS B 0601) of a surface of the chill roll to control a spacing between adjacent R-rich phases in a crystal structure of resulting alloy flakes to a fixed desired value, the temperature of the molten alloy is adjusted for each casting step based on a relation among Δt, ΔRa, and ΔSm: where Δt: an amount of adjustment (° C.) to be made to the molten alloy temperature;

ΔRa: an amount of change (μm) in the arithmetic mean roughness Ra (as defined in JIS B 0601) of the surface of the chill roll based on a particular casting step in the multiple casting steps;

ΔSm: an amount of change (μm) in the mean spacing of profile irregularities Sm (as defined in JIS B 0601) of the surface of the chill roll based on a particular casting step in the multiple casting steps.

2. The method of producing rare earth alloy flakes according to claim 1, further comprising a step of specifying a correlation coefficient α for the following equation (1), wherein, in the step of preparing the molten R-T-B-based alloy each of said multiple times, the temperature of the molten alloy is adjusted in accordance with the following equation (1) by using the correlation coefficient specified in the step of specifying a correlation coefficient α:

$$\Delta t=-7\times(|\Delta Ra|\times|\Delta Sm|)^{0.5}/\alpha \quad (1)$$ where α: a correlation coefficient (α>0).

3. The method of producing rare earth alloy flakes according to claim 2, wherein the surface of the chill roll has an arithmetic mean roughness Ra (as defined in JIS B 0601) of 2 to 20 μm and a mean spacing of profile irregularities Sm (as defined in JIS B 0601) of 100 to 1000 μm.

4. The method of producing rare earth alloy flakes according to claim 2, wherein:

the spacing between adjacent R-rich phases is controlled to be within a range of ±0.1 μm from the fixed desired value.

5. The method of producing rare earth alloy flakes according to claim 1, wherein the surface of the chill roll has an arithmetic mean roughness Ra (as defined in JIS B 0601) of 2 to 20 μm and a mean spacing of profile irregularities Sm (as defined in JIS B 0601) of 100 to 1000 μm.

6. The method of producing rare earth alloy flakes according to claim 5, wherein: the spacing between adjacent R-rich phases is controlled to be within a range of ±0.1 μm from the fixed desired value.

7. The method of producing rare earth alloy flakes according to claim 1, wherein:

the spacing between adjacent R-rich phases is controlled to be within a range of ±0.1 μm from the fixed desired value.

8. The method of producing rare earth alloy flakes according to claim 3, wherein:

the spacing between adjacent R-rich phases is controlled to be within a range of ±0.1 μm from the fixed desired value.

* * * * *